US007070415B2

(12) United States Patent
Hojo et al.

(10) Patent No.: US 7,070,415 B2
(45) Date of Patent: Jul. 4, 2006

(54) BALANCE TRAINING DEVICE

(75) Inventors: Hiroyuki Hojo, Hikone (JP); Ryusuke Nakanishi, Nagoya (JP); Yoichi Shinomiya, Ibaraki (JP); Tsuyoshi Yamamoto, Tokyo (JP)

(73) Assignee: Matsushita Electric Works, Ltd., Kadoma (JP)

( * ) Notice: Subject to any disclaimer, the term of this patent is extended or adjusted under 35 U.S.C. 154(b) by 884 days.

(21) Appl. No.: 10/049,055

(22) PCT Filed: Jun. 6, 2001

(86) PCT No.: PCT/JP01/04767

§ 371 (c)(1),
(2), (4) Date: Feb. 7, 2002

(87) PCT Pub. No.: WO01/93961

PCT Pub. Date: Dec. 13, 2001

(65) Prior Publication Data

US 2002/0115536 A1 Aug. 22, 2002

(30) Foreign Application Priority Data

Jun. 7, 2000 (JP) ..... 2000-171263

(51) Int. Cl.
*A63B 69/04* (2006.01)

(52) U.S. Cl. ..... 434/247; 472/59

(58) Field of Classification Search ..... 472/59–60; 434/247, 255; 482/1–9, 54, 57
See application file for complete search history.

(56) References Cited

U.S. PATENT DOCUMENTS

| | | | | |
|---|---|---|---|---|
| 5,527,239 | A | 6/1996 | Abbondanza | |
| 6,447,424 | B1 * | 9/2002 | Ashby et al. | 482/8 |
| 6,471,622 | B1 * | 10/2002 | Hammer et al. | 482/54 |

FOREIGN PATENT DOCUMENTS

| | | | |
|---|---|---|---|
| CA | 2 246 625 | * | 8/1997 |
| EP | 0 612 542 | B1 | 8/1994 |
| EP | 0 963 767 | | 12/1999 |
| JP | 5-76658 | | 3/1993 |
| JP | 06-65350 | | 8/1994 |
| JP | 11-4911 | | 1/1999 |
| WO | 97/29815 | | 8/1997 |
| WO | WO 98/32501 | | 7/1998 |
| WO | 99/55427 | | 11/1999 |

* cited by examiner

*Primary Examiner*—Kien Nguyen
(74) *Attorney, Agent, or Firm*—Oblon, Spivak, McClelland, Maier & Neustadt, P.C.

(57) ABSTRACT

A balance training apparatus, which is preferably used for training a body balance function and a locomotive function of a user, and for rehabilitation for lumbago prevention, is provided. This apparatus has a seat for the user and a driving unit for driving the seat. The driving unit comprises a drive source and a power transmission unit for converting an output of the drive source into a horse-riding motion, which is a combination of a rectilinear reciprocating motion in a forward and backward direction (X) of the seat, a first pivotal reciprocating motion (θy) about an axis extending in a horizontal direction substantially perpendicular to the forward and backward direction, and a second pivotal reciprocating motion (θx) about an axis extending in the forward and backward direction, and transferring the horse-riding motion to the seat.

14 Claims, 6 Drawing Sheets

BALANCE TRAINING DEVICE

TECHNICAL FIELD

The present invention relates to a balance training apparatus having a seat for a user, which is preferably used for training a body balance function and a locomotive function of a user, and for rehabilitation for lumbago prevention.

BACKGROUND ART

Horse-riding is well known as an effective exercise for preventing lumbago and for increasing muscular strength of legs and loins. However, it is difficult that most of people living in cities go to horse-riding facilities from viewpoints of time and expense. In addition, there is a danger that an unripe person in horse-riding technique falls from a horseback. Therefore, attention is being given to an apparatus for providing an artificial horse-riding exercise by simulating an exercise that the user receives during the horse-riding.

For example, Japanese Patent Publication [kokoku] No. 6-65350 discloses a balance training apparatus comprising a horse-shaped seat for a user, six independent drive motors, and a power transmission unit for transferring outputs of these motors to the seat. In this apparatus, it is possible to separately control six motions of rectilinear reciprocating motions in a forward and backward direction, left and right direction, and an upward and downward direction, and pivotal reciprocating motions about an axis of the forward and backward direction, axis of the left and right direction, and an axis of the upward and downward direction. In the case of providing these rectilinear reciprocating motions and pivotal reciprocating motions to the user on the seat at required speeds, a position of the center of gravity of the user's body changes during the exercise. Since the user holds out, bracing the legs to keep the head position constant, it is possible to efficiently train specific muscles of the user.

By the way, from a detail analysis of the present inventors about a relation between muscle motions in the horse-riding exercise and an effect of increasing the muscle power brought thereby, it has been concluded that a combination of specific three motions in the above-described six motions is particularly effective for the balance training and the lumbago prevention. That is, it has been revealed that the rectilinear reciprocating motion in the forward and backward direction of the seat and the pivotal reciprocating motion about the axis extending in the horizontal direction substantially perpendicular to the forward and backward direction are effective for abdominal and back muscles, and the pivotal reciprocating motion about the axis extending in the forward and backward direction is effective for external abdominal oblique muscle. In addition, it has been revealed that even when the remaining motions other than the above-described three motions are given to the user, remarkable effects of increasing the muscle power cannot be expected. Thus, from the viewpoint of efficiently training the specific muscles of the user, there is still room for improvement in the conventional balance training apparatus.

In addition, since many motors built in the conventional apparatus bring about an upsizing of the apparatus, the ease-of-use of the apparatus is not often satisfied in average homes and offices. Moreover, the use of a lot of motors and the upsizing of the apparatus lead to poor cost/performance. Consequently, it has become a very expensive apparatus to the average homes.

SUMMARY OF THE INVENTION

Therefore, a primary concern of the present invention is to provide a balance training apparatus having the capability of giving a horse-riding exercise that is a combination of the three effective motions described above, to a user on a seat.

That is, the balance training apparatus has a seat for a user, and a driving unit for driving the seat. The driving unit comprises a drive source and a power transmission means for converting an output of the drive source into a horse-riding motion, which is a combination of a rectilinear reciprocating motion in a forward and backward direction of the seat, a first pivotal reciprocating motion about a first axis extending in a horizontal direction substantially perpendicular to the forward and backward direction, and a second pivotal reciprocating motion about a second axis extending in the forward and backward direction, and transferring the horse-riding motion to the seat.

In this balance training apparatus, there is an advantage of efficiently providing an exercise, which is particularly effective for training a body balance function and a locomotive function of the user and for rehabilitation for lumbago prevention, to the user on the seat. In addition, since a mechanism for transferring to the seat the other motions that do not provide remarkable exercise effects is not needed, it is possible to downsize the apparatus, and cut down on costs of the apparatus in such a degree that the apparatus can be easily used in average homes.

In the above balance training apparatus, it is preferred that a range of the rectilinear reciprocating motion is ±50 mm or less in the forward and backward direction, a range of the first pivotal reciprocating motion is ±5 degrees or less about the first axis, and a range of the second pivotal reciprocating motion is ±5 degrees or less about the second axis.

In addition, it is preferred that the balance training apparatus comprises a movement range adjusting means for adjusting each of ranges of the rectilinear reciprocating motion, the first pivotal reciprocating motion, and the second pivotal reciprocating motion.

It is further preferred that the balance training apparatus comprises a speed adjusting means for adjusting each of speeds of the rectilinear reciprocating motion, the first pivotal reciprocating motion, and the second pivotal reciprocating motion.

In addition, it is preferred that the balance training apparatus comprises a movement ratio adjusting means for adjusting a movement ratio among the rectilinear reciprocating motion, the first pivotal reciprocating motion, and the second pivotal reciprocating motion.

It is also preferred that the balance training apparatus comprises a control means for controlling the driving unit to provide the horse-riding motion according to a predetermined program.

It is preferred that the control means has a slow start means for controlling the driving unit such that a traveling speed of the seat gradually increases from the start of the horse-riding motion.

In addition, it is preferred that the control means controls the driving unit according to a program prepared in consideration of a warming-up exercise performed at the start of the horse-riding motion and a cool-down exercise performed at the end of the horse-riding motion. In particular, it is preferred that the control means controls the driving unit such that a traveling speed of the seat gradually increases at the warming-up exercise, and the traveling speed of the seat gradually decreases at the cool-down exercise.

It is further preferred that the control means comprises a heart rate sensor for measuring a heart rate of the user on the seat during the horse-riding motion, and a feedback means for adjusting at least one of a traveling speed and a movement range of the seat according to an output of the heart rate sensor.

In addition, it is preferred that the control means comprises a data input portion for inputting an amount of calories that the user wants to burn by an exercise, exercise program determining portion for determining a horse-riding exercise program according to the calorie amount in the data input portion, and a calorie display portion for displaying consumed calories by the user during the exercise.

In addition, it is preferred that the control means has a maximum speed determining means for setting a maximum traveling speed of the seat to a desired value Other features and advantages brought thereby of the present invention will be more apparently understood from best mode for carrying out the invention explained below in detail, referring to the attached drawings.

BEST MODE FOR CARRYING OUT THE INVENTION

A balance training apparatus according to a preferred embodiment of the present invention is explained below in detail.

Figure 1A:
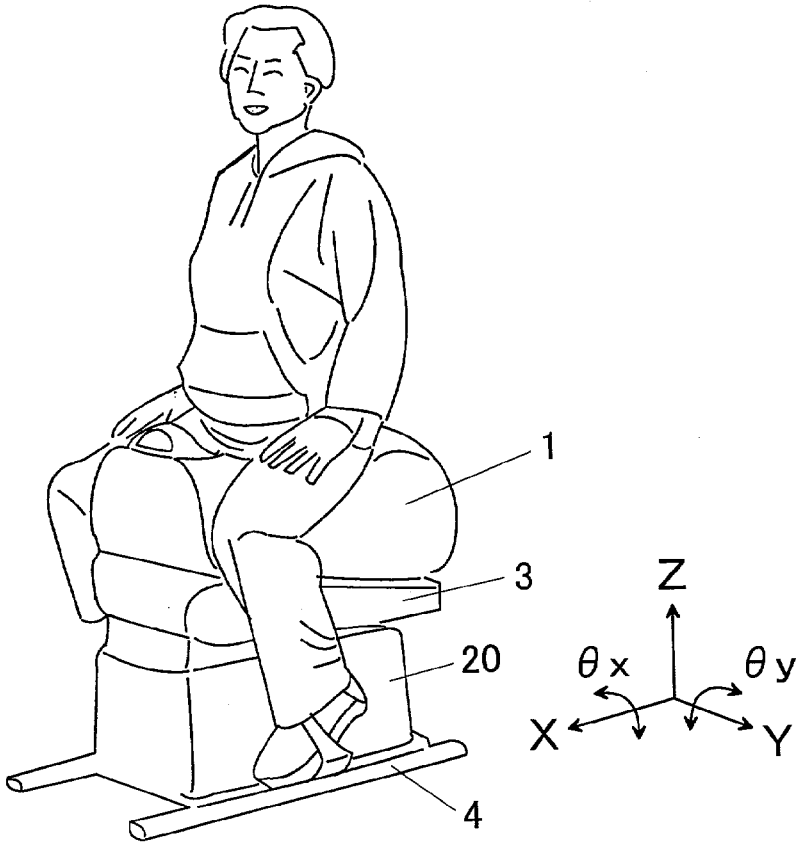
FIG. 1A is a schematic view showing a usage of a balance training apparatus according to an embodiment of the present invention.
Figure 1B:
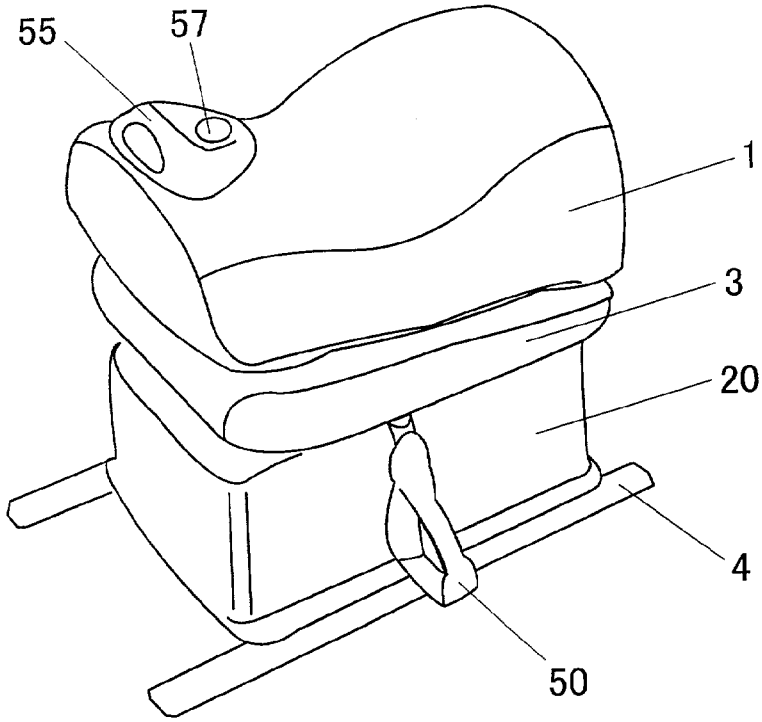
FIG. 1B is a perspective view of the balance training apparatus.

As shown in FIG. 1A, when using the balance training apparatus of present embodiment, a user sits astride a seat 1. As shown in FIGS. 1B, 3 to 5, this apparatus comprises a base 4, a movable carrier 8 pivotally supported about an axis of a first shaft 6 described later by the base 4, driving unit 2 mounted on the movable carrier 8, a pedestal 3 movably supported to the movable carrier 8 by use of a pair of first links 9 described later, and the seat 1 fixed to the a top plate 3*a* of the pedestal 3. In FIG. 1B, the numeral 50 designates stirrups for holding the user's feet. The numeral 20 designates a cover, in which the driving unit 2 is installed. In addition, the numeral 55 designates a grip, which can be used to keep the balance by the user on the seat during the horse-riding exercise. The numeral 57 designates an operating panel with a main switch of the balance training apparatus and so on.

Figure 2A:
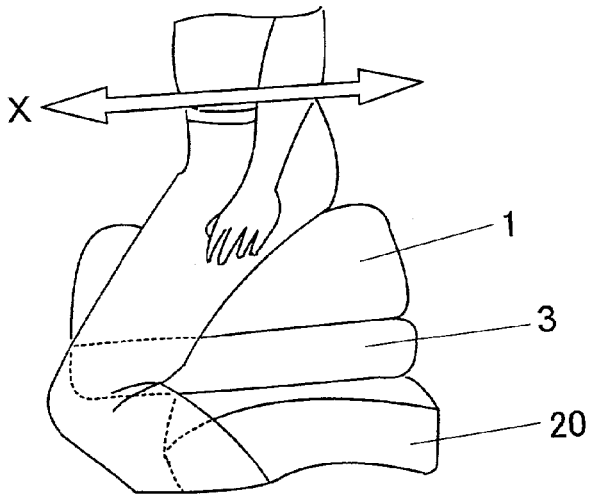
FIG. 2A is a schematic view illustrating a rectilinear reciprocating motion in a forward and backward direction (X) of a seat.
Figure 2B:
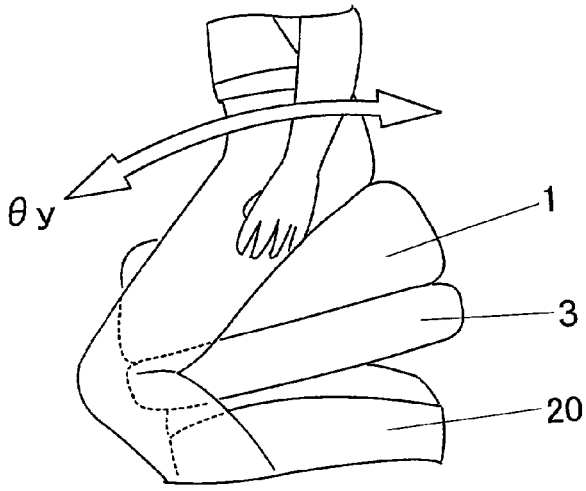
FIG. 2B is a schematic view illustrating a first pivotal reciprocating motion (θy) about an axis extending in a horizontal direction substantially perpendicular to the forward and backward direction.
Figure 2C:
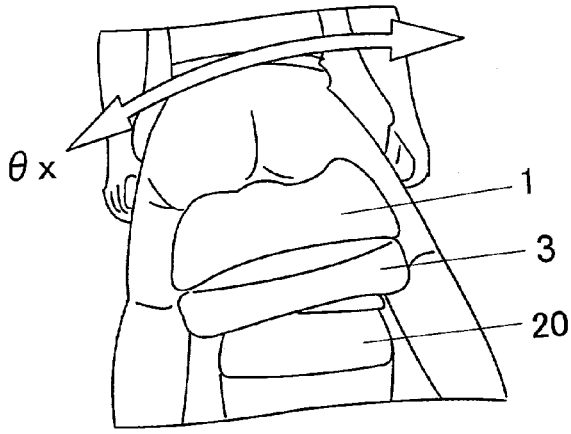
FIG. 2C is a schematic view illustrating a second pivotal reciprocating motion (θx) about an axis extending in the forward and backward direction.

The seat 1 is of a saddle shape having a concave at a substantially center portion between the forward and backward ends thereof, which is formed such that the user can sit astride this concave. The driving unit 2 is mainly composed of a single motor 16 and a power transmission unit for transferring an output of the motor to the seat 1. This power transmission unit converts a rotational output of the motor 16 into a horse-riding motion, which is a combination of a rectilinear reciprocating motion in the forward and backward direction (X) of the seat, as shown in FIG. 2A, a first pivotal reciprocating motion (θy) about an axis extending in a horizontal direction substantially perpendicular to the forward and backward direction, as shown in FIG. 2B, and a second pivotal reciprocating motion (θx) about an axis extending in the forward and backward direction, as shown in FIG. 2C, and transfers the horse-riding motion to the seat. To facilitate the understanding of the present invention, a first crank mechanism for converting the output of the motor 16 into the rectilinear reciprocating motion and the first pivotal reciprocating motion of the seat 1 is firstly explained. Subsequently, a second crank mechanism for converting the motor output into the second pivotal reciprocating motion of the seat 1 is explained.

(1) First Crank Mechanism

Figure 3:
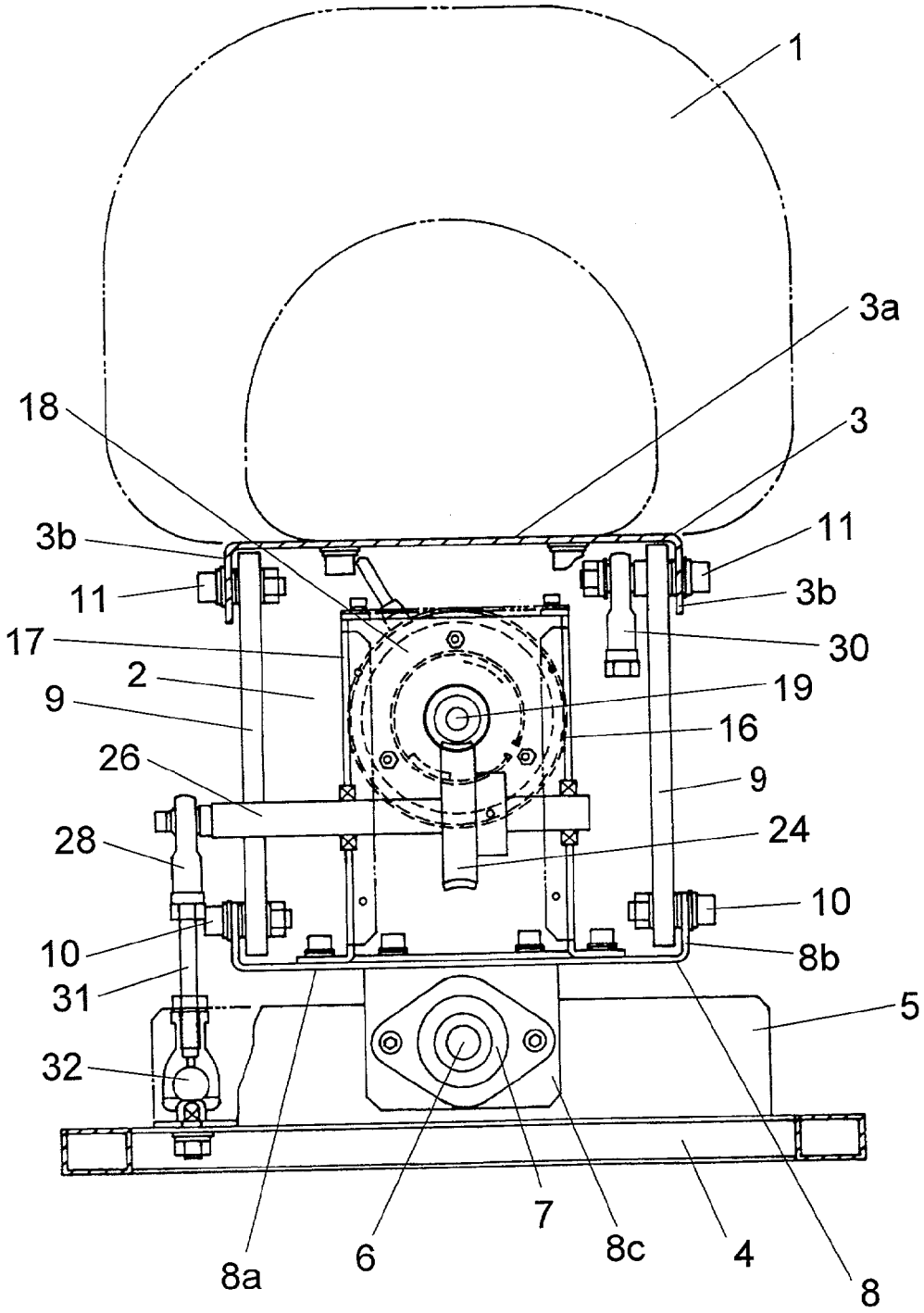
FIG. 3 is a front cross-sectional view of the balance training apparatus according to the embodiment of the present invention.
Figure 4:
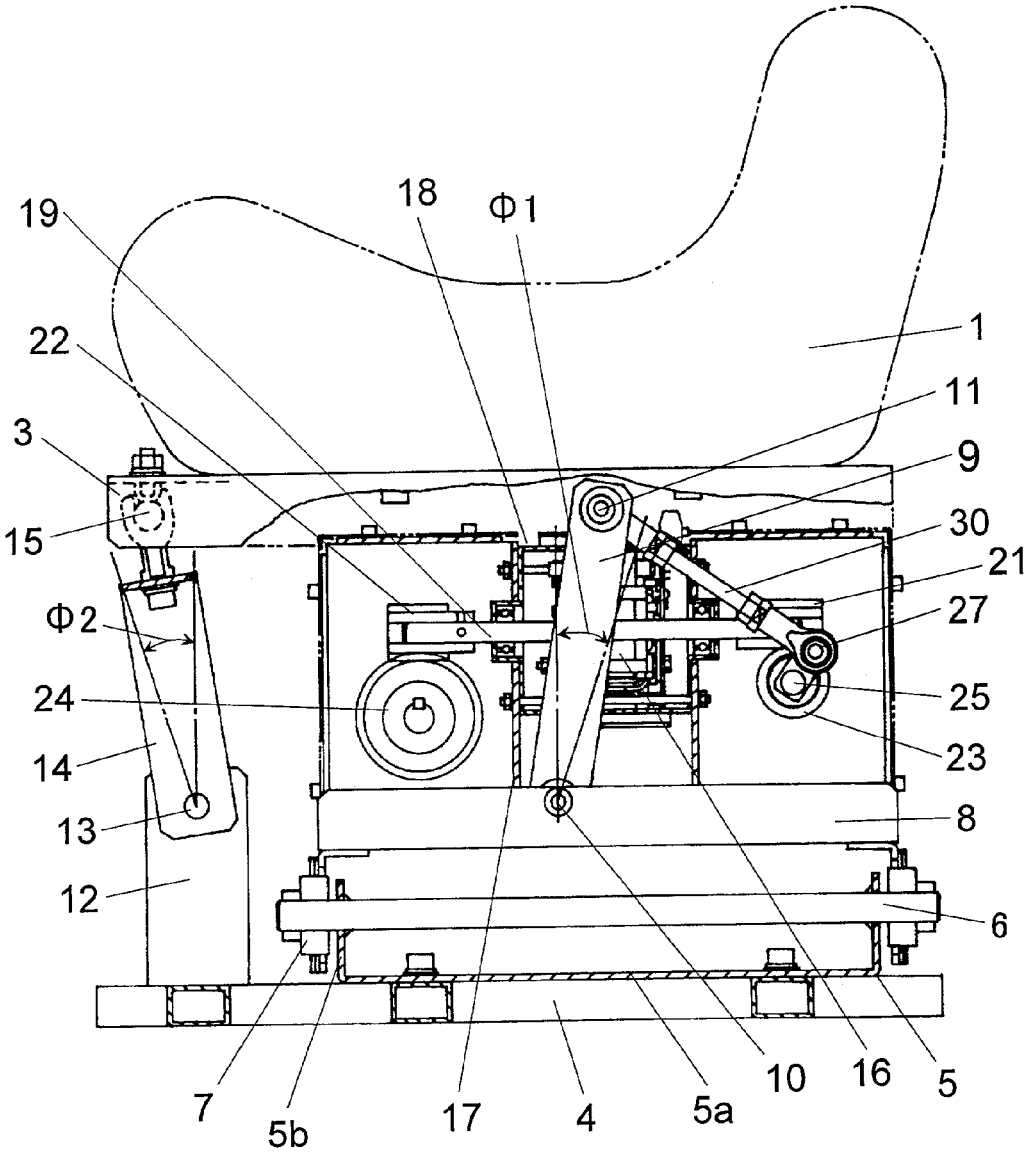
FIG. 4 is a side cross-sectional view of the balance training apparatus.
Figure 5:
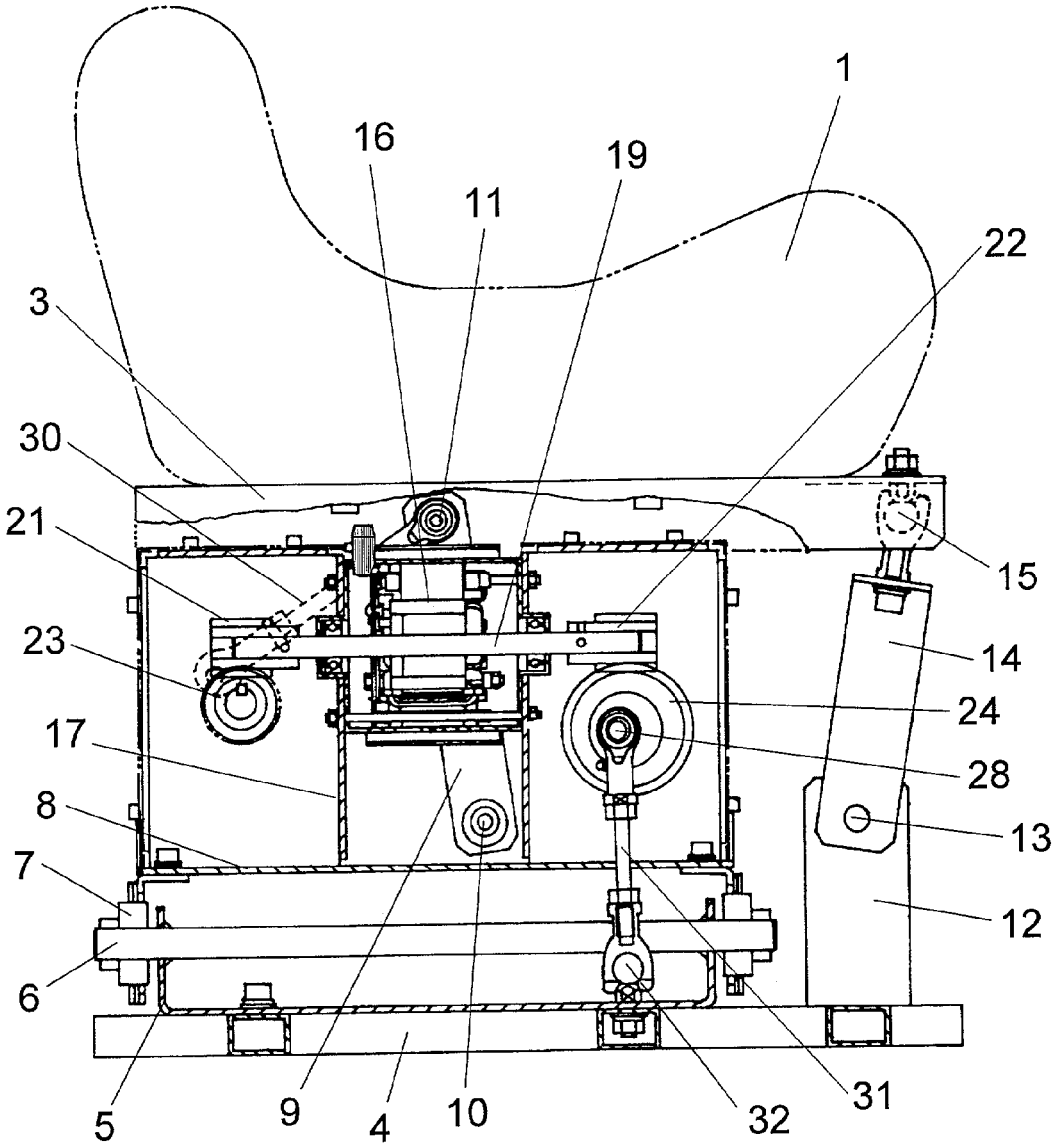
FIG. 5 is a side cross-sectional view of the balance training apparatus.

As shown in FIGS. 3 to 5, the single motor 16 is fixed to the movable carrier 8, on which the driving unit 2 is mounted, by use of a motor mounting stand 17. A rotating shaft 19 of the motor 16 penetrates a motor case 18, and projects from opposite ends of the motor case to provide a rotational output. In this embodiment, a rear end of the rotating shaft 19 is used to provide the rectilinear reciprocating motion and the first pivotal reciprocating motion, and the front end of the rotating shaft is used to provide the second pivotal reciprocating motion.

A worm 21 is provided at the rear end of the rotating shaft 19. The worm 21 is engaged to a worm wheel 23. The worm wheel 23 is attached to a shaft pin 25 extending in a horizontal direction. The shaft pin 25 is coupled to a first crank 27. The first crank 27 is coupled with one end of a first link 9 by a first rod 30. The end of the first link 9 is coupled to a side wall 3*b* of the pedestal 3, to which the seat 1 is secured, by use of a shaft pin 11. The other end of the first link 9 is coupled to a side wall 8*b* of the movable carrier 8 by use of a shaft pin 10. The first link 9 is provided at each of both sides of the seat 1. However, a crank motion is transferred to only one of the first links 9 (right-side one in FIG. 3) by the first rod 30. The other one of the first links (left-side one in FIG. 3) is dependently driven. In addition, as shown in FIG. 3, the shaft pins (10, 11) are arranged such that an axial direction of the shaft pin 10 is substantially parallel to the axial direction of the shaft pin 11. The axial direction of the shaft pins (10, 11) is substantially perpendicular to the forward and backward direction of the seat 1.

In the power transmission mechanism described above, when the motor 16 is activated, the worm 21 rotates the worm wheel 23, so that the first crank 27 revolves about the shaft pin 25. This crank motion of the first crank 27 is transferred to the first link 9 through the first rod 30. As a result, the first link 9 is allowed to do a reciprocating swing motion within a range of angle designated by Φ1 about the shaft pin 10 as a rotation center. This motion of the first link 9 provides an oscillatory reciprocating motion to the pedestal 3 with the seat 1.

By the way, the motion of the seat 1 is guided by a second link 14 for coupling a front portion of the pedestal 3 with a supporting board 12 standing on a forward end of the base 4. That is, one end of the second link 14 is coupled to the supporting board 12 by use of a shaft pin 13 such that the second link is allowed to do a reciprocating swing motion within a range of angle designated by Φ2 about the coupling portion as a rotation center. A ball joint 15 that is a universal joint is provided at the other end of the second link 14. The second link 14 is coupled to the pedestal 3 by use of the ball joint 15. In this embodiment, a linear distance between the shaft pins (10, 13) is smaller than the linear distance between the shaft pin 11 and the ball joint 15.

In the presence of the second link 14, when the first link 9 is pivotally moved in a counterclockwise direction about the pin shaft 10 from a position shown in FIG. 4, at which a top face of the pedestal 3 is substantially parallel to the top face of the base 4, the first link pushes up a rear portion of the pedestal 3, and the second link 14 dependently moves in the counterclockwise direction to push down the front portion of the pedestal 3. On the contrary, when the first link 9 is pivotally moved in a clockwise direction about the pin shaft 10 from the position shown in FIG. 4, the seat 1 moves rearward such that a rear end portion of the seat 1 is lower than a front end portion of the seat 1.

Thus, the reciprocating swing motions of the first and second links 9, 14 provides to the seat 1 a combined motion of the rectilinear reciprocating motion in the forward and backward direction (X) of the seat and the first pivotal reciprocating motion (θy) about the axis extending in the horizontal direction substantially perpendicular to the forward and backward direction.

(2) Second Crank Mechanism

A worm 22 provided at the front end of the rotating shaft 19 of the motor 16 is used to provide the second pivotal reciprocating motion to the seat 1. The worm 22 is engaged to a worm wheel 24. As shown in FIG. 3, the worm wheel 24 is attached to a shaft pin 26 extending in a horizontal direction. A second crank 28 is coupled to one end of the shaft pin 26. The second crank 28 is coupled with the base 4 by a second rod 31. The second rod 31 is coupled to the top surface of the base 4 by use of a ball joint 32 that is a universal joint.

The movable carrier 8 is supported so as to be pivotally movable about the first shaft 6 extending in the forward and backward direction against the base 4. That is, as shown in FIG. 4, a securing member 5 shaped like a letter C is fixed to the base 4. This securing member 5 is formed with a bottom wall 5*a*, which is fixed to the base 4 by use of fixtures such as bolts and nuts, and a pair of front and rear walls 5*b* projecting upward from front and rear ends of the bottom wall. The first shaft 6 is supported by the front and rear walls 5*b*. A pair of bearings 7 are held by bearing holding members 8*c* projecting downward from front and rear ends of a bottom plate 8*a* of the movable carrier 8. Both ends of the first shaft 6 are also supported by the pair of bearings 7, so that the movable carrier 8 can be pivotally moved about the first shaft 6. In the present embodiment, as understood from the front view of FIG. 3, the first and second crank mechanisms are positioned at the right and left sides of the first shaft 6, respectively.

As described above, the movable carrier 8 with the seat 1, the pedestal 3 and the driving unit 2 thereon is pivotally movable about the first shaft 6 against the base 4. Therefore, when the motor 16 is activated, the worm 22 provided at the front end of the motor shaft 19 rotates the worm wheel 24, so that the second crank 28 revolves about the shaft pin 26. A crank motion of this second crank 28 is transferred through the second rod 31. However, since one end of the second rod 31 is secured to the base 4, the movable carrier 8 is allowed to do a reciprocating swing motion about the first shaft 6. Thus, by the crank motion of the second crank 28, the movable carrier 8 with the pedestal 3 and the seat 1 thereon is allowed to do the reciprocating swing motion about the first shaft 6. Since one end of the second crank 28 is coupled to the base 4 through the ball joint 32, the oscillatory motion of the movable carrier 8 about the first shaft 6 is permitted.

As a result, the rotational output of the single motor 16 is converted into an artificial horse-riding motion, which is a combination of the rectilinear reciprocating motion in the forward and backward direction of the seat, the first and second pivotal reciprocating motions, by the first and second crank mechanisms, and the horse-riding motion is provided to the seat 1. This means that the seat 1 can oscillate with 3 degrees of freedom. Myoelectric potentials for abdominal and back muscles are obtained by the rectilinear reciprocating motion and the first pivotal reciprocating motion, and the myoelectric potentials for external abdominal oblique muscle are obtained by the second pivotal reciprocating motion. Since these myoelectric potentials caused at the time of stretching the respective muscles are alternately obtained, it is possible to provide remarkable effects of balance training.

Therefore, a preferred balance training apparatus of the present invention has a seat for a user, and a driving unit for moving the seat. The driving unit comprises a single motor and a power transmission unit for converting an output of the single motor into an artificial horse-riding motion, which is a combination of a rectilinear reciprocating motion in a forward and backward direction of the seat, a first pivotal reciprocating motion about a first axis extending in a horizontal direction substantially perpendicular to the forward and backward direction, and a second pivotal reciprocating motion about a second axis extending in the forward and backward direction, and transferring the horse-riding motion to the seat.

In particular, it is preferred that the power transmission unit of the present invention is composed of a first crank mechanism of converting a rotational output provided from one end of a rotating shaft of the single motor into a first crank motion to obtain the rectilinear reciprocating motion in the forward and backward direction of the seat, and the first pivotal reciprocating motion about the first axis extending in the horizontal direction substantially perpendicular to the forward and backward direction, and a second crank mechanism of converting the rotational output provided from the other end of the rotating shaft of the single motor into a second crank motion to obtain the second pivotal reciprocating motion about the second axis extending in the forward and backward direction.

Figure 6:
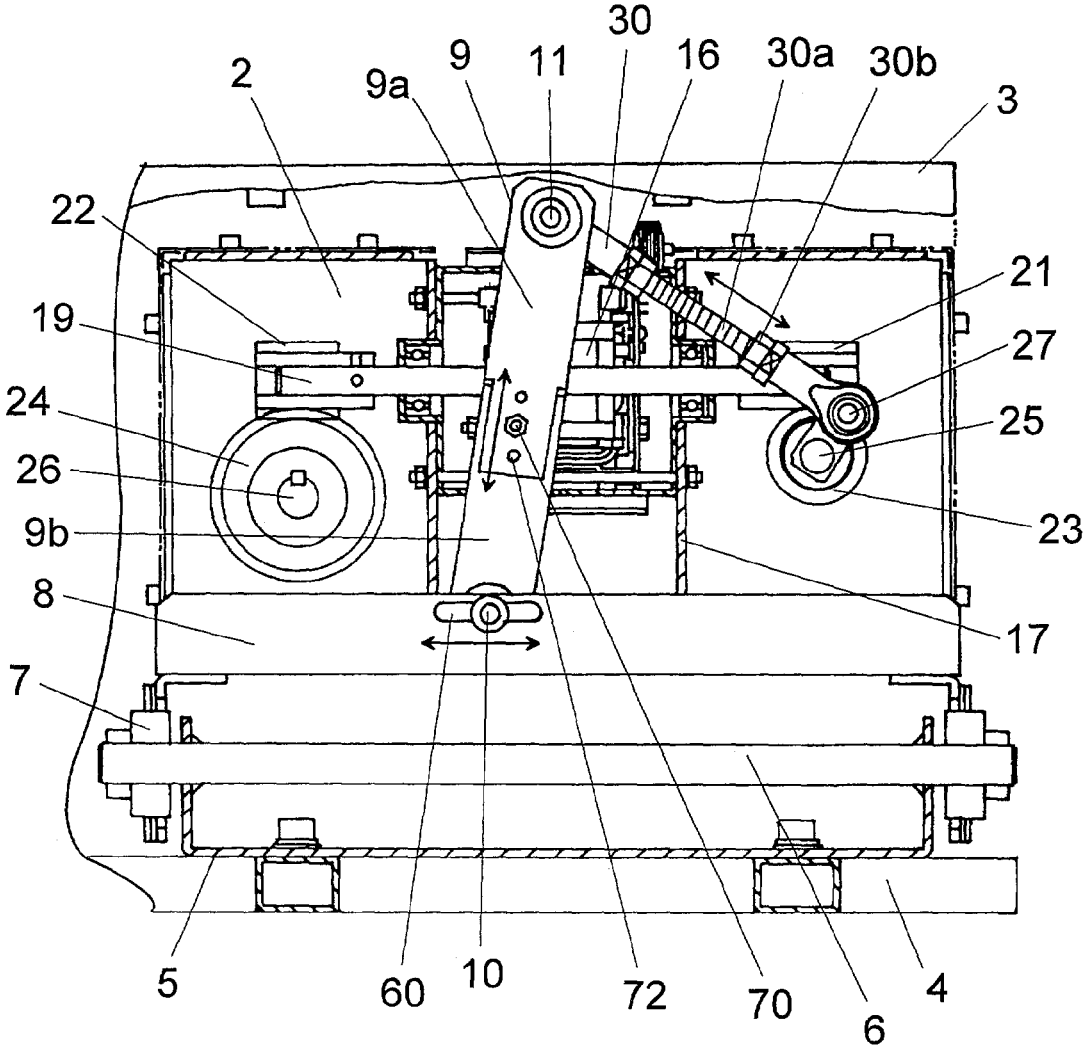
FIG. 6 is a cross-sectional view of a balance training apparatus according to another embodiment of the present invention.

It is preferred that the balance training apparatus of the present invention comprises a movement range adjusting unit for adjusting movement ranges in the horse-riding motion. For example, as shown in FIG. 6, to adjust a range of the rectilinear reciprocating motion in the forward and backward direction (X) and a range of angle (θy) of the second pivotal reciprocating motion of the seat, an effective length of the first rod 30 can be determined by tightening a nut 30*b* to a required position of a bolt 30*a* that works as the first rod, and a coupling position of the first link 9 (i.e., the position of the shaft pin 10) can be adjusted in an elongate hole 60, which is formed in a side wall 8*b* of the movable carrier 8 so as to extend in the forward and backward direction. In addition, when the first link 9 is composed of a pair of link members 9*a*, 9*b*, and a plurality of bolt holes 72 for coupling are formed in the link members in its longitudinal direction, the link members 9*a*, 9*b* can be coupled to each other by use of a bolt 70 such that a total length of the first link 9 becomes a required length. On the other hand, to change a range of angle (θx) of the second pivotal reciprocating motion of the seat, it is preferred that a radius of gyration of the second crank is adjustable. Each of these movement range adjusting units works as the movement range adjusting means of the present invention. In particular, when the balance training apparatus of the present invention has these movement range adjusting units, a movement ratio among the three different motions can be optionally determined. Therefore, the balance training apparatus also has a movement ratio adjusting means.

The movement range and the ranges of angles in the oscillatory reciprocating motion of the seat can be changed by the movement range adjusting means described above, therefore, they are not limited to specific ranges. However, it is preferred that the range of the rectilinear reciprocating motion is ±50 mm or less in the forward and backward direction, the range of the first pivotal reciprocating motion is ±5 degrees or less about the first axis, and the range of the second pivotal reciprocating motion is ±5 degrees or less about the second axis. In this case, it is possible to efficiently provide improved muscle training and balance training effects to the user.

In addition, by controlling a rotation speed of the motor 16, the reciprocating motions can be provided at various oscillation speeds. In particular, it is preferred that the present apparatus comprises a maximum-speed determining means for setting a maximum traveling speed of the seat to a desired value.

To provide an effective exercise for balance training to the user by the balance training apparatus of the present invention, it is also preferred that the present apparatus comprises a control unit for controlling driving conditions such as drive speed and exercise continuation time according to a predetermined program menu. In this case, it is possible to provide a suitable horse-riding exercise in accordance with the program menu prepared for individual purposes of increasing the muscle power, rehabilitation for lumbago prevention, and so on.

For example, it is preferred that the present apparatus comprises a slow start means for controlling the driving unit such that a traveling speed of the seat gradually increases from the start of driving. In addition, it is preferred that the control unit controls the driving unit according to a program prepared in consideration of a warming-up exercise for the user at the start of the horse-riding motion and a cool-down exercise for the user at the end of the horse-riding motion. Concretely, it is preferred that the control unit controls the driving unit according to the program prepared such that the traveling speed of the seat gradually increases (slow start) at the warming-up exercise, and the traveling speed of the seat gradually decreases (slow end) at the cool-down exercise. In this case, the muscles of the user are efficiently induced in an adequate condition for exercise, and the flow of blood can be gradually stabilized by easing the muscle tension immediately before the end of the exercise.

By the way, the contents of the exercise program are carefully determined by a lot of preliminary tests. However, there is a case that a selected exercise menu is not adequate for the user due to individual differences. In addition, even when the exercise is carried out along the program, there is a case that the exercise becomes an excessive load due to a poor physical condition of the user. For these reasons, it is preferred that the present apparatus comprises a heart-rate sensor for measuring a heart rate of the user on the seat 1 during the horse-riding motion, and a feedback unit for adjusting at least one of the traveling speed and the movement range of the seat according to an output of the heart-rate sensor. In this case, since an adequate amount of exercise is determined according to the physical condition of the user during the exercise, the reliability in safety of the apparatus is further improved.

In addition, when the user uses the balance training apparatus to burn desired calories, it is preferred that the present apparatus comprises a data input portion for inputting an amount of calories that the user wants to burn by an exercise, together with individual data of the user such as gender and age, exercise program determining portion for determining an optimum exercise program according to the input data, and a calorie display portion for displaying consumed calories by the user during the exercise. In this case, since the user can continue the exercise while checking the consumed calories by the exercise, it becomes easier to grasp a distribution of pace for the exercise. In addition, the user can obtain information about the remaining exercise amount necessary to reach the desired calorie consumption amount set by the user. Therefore, it is effective to raise the aspirations of attaining the user's goal. For example, it is preferred that the calorie display portion is positioned at an operating panel 57 of the seat 1.

INDUSTRIAL APPLICABILITY

As described above, since the present apparatus can provide a simulated horse-riding, three-dimensional motion to the seat, on which the user is sitting, it is possible to efficiently train specific muscles of the user. That is, it is possible to efficiently provide to the user the horse-riding motion, which is a combination of the rectilinear reciprocating motion in the forward and backward direction and the first pivotal reciprocating motion that are effective to train abdominal and back muscles, and the second pivotal reciprocating motion that is effective to train external abdominal oblique muscle.

In addition, when the balance training apparatus provides the horse-riding motion by use of the single motor, it is possible to achieve a downsizing of the apparatus, and remarkably improve the cost/performance. As a result, the apparatus for providing the exercise effective for improving the muscle power and for the lumbago prevention becomes available to average homes as well as the commercial use. The balance training apparatus of the present invention is also effective to another purposes such as resolving lack of exercise, refreshing and a shape-up exercise.

In the case that the training program can be determined according to gender, age, physique and physical conditions of the user, or the heart rate or the consumed calories of the user can be measured and displayed in a real-time manner, there is an advantage that the user is allowed to safely use the balance training apparatus while avoiding a situation that an excessive amount of exercise is applied to the user.

The invention claimed is:

1. A balance training apparatus comprising:

a seat for a user; and a driving unit configured to drive said seat and comprising:

a motor; and a power transmission configured to convert an output of said motor into a horse-riding motion and transfer said horse-riding motion to said seat, said horse-riding motion being a combination of a rectilinear reciprocating motion in a forward and backward direction of said seat, a first pivotal reciprocating motion about a first axis extending in a horizontal direction substantially perpendicular to said forward and backward direction, and a second pivotal reciprocating motion about a second axis extending in said forward and backward direction, wherein said power transmission comprises a first crank mechanism configured to provide said rectilinear reciprocating motion and said first pivotal reciprocating motion, and a second crank mechanism configured to provide said second pivotal reciprocating motion, and both of said first and second crank mechanisms are coupled to a rotating shaft of said motor.

2. The balance training apparatus as set forth in claim 1, wherein a range of said rectilinear reciprocating motion is ±50 mm or less in said forward and backward direction, a range of said first pivotal reciprocating motion is ±5 degrees or less about the first axis, and a range of said second pivotal reciprocating motion is ±5 degrees or less about the second axis.

3. The balance training apparatus as set forth in claim 1, comprising a movement range adjusting device configured to adjust each of ranges of said rectilinear reciprocating motion, said first pivotal reciprocating motion, and said second pivotal reciprocating motion.

4. The balance training apparatus as set forth in claim 1, comprising a speed adjusting device configured to adjust each of speeds of said rectilinear reciprocating motion, said first pivotal reciprocating motion, and said second pivotal reciprocating motion.

5. The balance training apparatus as set forth in claim 1, comprising a movement ratio adjusting device configured to adjust a movement ratio among said rectilinear reciprocating motion, said first pivotal reciprocating motion, and said second pivotal reciprocating motion.

6. The balance training apparatus as set forth in claim 1, comprising a controller configured to control said driving unit to provide said horse-riding motion according to a predetermined program.

7. The balance training apparatus as set forth in claim 6, wherein said controller has a slow start device configured to control said driving unit such that a traveling speed of said seat gradually increases from the start of said horse-riding motion.

8. The balance training apparatus as set forth in claim 6, wherein said controller controls said driving unit according to a program prepared in consideration of a warming-up exercise performed at the start of said horse-riding motion and a cool-down exercise performed at the end of said horse-riding motion.

9. The balance training apparatus as set forth in claim 8, wherein said controller controls said driving unit such that a traveling speed of said seat gradually increases at said warming-up exercise, and the traveling speed of said seat gradually decreases at said cool-down exercise.

10. The balance training apparatus as set forth in claim 6, wherein said controller comprises a heart rate sensor configured to measure a heart rate of the user on said seat during said horse-riding motion, and a feedback device configured to adjust at least one of a traveling speed and a movement range of said seat according to an output of said heart rate sensor.

11. The balance training apparatus as set forth in claim 6, wherein said controller comprises a data input portion configured to input an amount of calories that the user wants to burn by an exercise, exercise program determining portion configured to determine a horse-riding exercise program according to the calorie amount in said data input portion, and a calorie display configured to display consumed calories by the user during the exercise.

12. The balance training apparatus as set forth in claim 6, wherein said controller has a maximum speed determining device configured to set a maximum traveling speed of said seat to a desired value.

13. The balance training apparatus as set forth in claim 1, wherein said first crank mechanism is coupled to one end of the rotating shaft of said motor, and said second crank mechanism is coupled to another end of the rotating shaft of said motor.

14. The balance training apparatus as set forth in claim 1, wherein said motor is mounted on a movable carrier, which is coupled with said seat, and movably supported by a base to enable said second pivotal reciprocating motion of said seat.

* * * * *